US008139970B2

(12) United States Patent
Kim et al.

(10) Patent No.: US 8,139,970 B2
(45) Date of Patent: Mar. 20, 2012

(54) IMAGE FIXING CONTROL SYSTEM AND METHOD TO INCREASE QUALITY OF FIXED IMAGE

(75) Inventors: Se-joong Kim, Seoul (KR); Sang-yong Han, Suwon-si (KR); Joong-gi Kwon, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 670 days.

(21) Appl. No.: 11/714,862

(22) Filed: Mar. 7, 2007

(65) Prior Publication Data

US 2007/0212095 A1 Sep. 13, 2007

(30) Foreign Application Priority Data

Mar. 13, 2006 (KR) ..... 10-2006-0023090

(51) Int. Cl.
*G03G 15/20* (2006.01)

(52) U.S. Cl. ..... 399/69; 399/67

(58) Field of Classification Search ..... 399/67, 399/69

See application file for complete search history.

(56) References Cited

U.S. PATENT DOCUMENTS

| | | | | |
|---|---|---|---|---|
| 4,493,984 | A | 1/1985 | Yamauchi | |
| 4,626,956 | A * | 12/1986 | Naito | 361/152 |
| 4,868,368 | A * | 9/1989 | Araki | 219/216 |
| 5,681,494 | A | 10/1997 | Suzuki et al. | |
| 5,758,228 | A | 5/1998 | Hirose et al. | |
| 6,097,006 | A | 8/2000 | Inukai | |
| 6,111,230 | A | 8/2000 | Cao et al. | |
| 2002/0014876 | A1 * | 2/2002 | Han et al. | 318/729 |
| 2003/0178410 | A1 | 9/2003 | Satoh | |
| 2006/0214512 | A1 * | 9/2006 | Iwata | 307/44 |
| 2007/0164714 | A1 * | 7/2007 | Nicholson et al. | 323/234 |

FOREIGN PATENT DOCUMENTS

| | | | |
|---|---|---|---|
| EP | 0668548 | A2 | 8/1995 |
| JP | 56-021206 | | 2/1981 |
| JP | 03012685 | | 1/1991 |
| JP | 06-067563 | | 3/1994 |
| JP | 2005-284309 | | 10/2005 |
| KR | 1020050067614 | A | 7/2005 |

* cited by examiner

*Primary Examiner* — Ryan Walsh

(74) *Attorney, Agent, or Firm* — Roylance, Abrams, Berdo & Goodman, LLP

(57) ABSTRACT

An image fixing control system and method are provided comprising a power supply, a power switching unit, a heating roller, in which a temperature detector detects a temperature of the heating roller, and a controller detects a temperature variation slope of the heating roller using the temperature detected by the temperature detector and controls an on and off switching operation of the power switching unit according to the detected temperature variation slope. Accordingly, by varying a duty ratio of power through a phase control using a temperature variation slope of a heating roller, a fine control of a fixing system can be performed. In addition, since a temperature variation, that is, overshoot or undershoot, of the heating roller is reduced, a fixing efficiency can be increased.

26 Claims, 5 Drawing Sheets

IMAGE FIXING CONTROL SYSTEM AND METHOD TO INCREASE QUALITY OF FIXED IMAGE

CROSS-REFERENCE TO RELATED PATENT APPLICATION

This application claims the benefit under 35 U.S.C. §119 (a) of Korean Patent Application No. 10-2006-0023090, filed on Mar. 13, 2006, in the Korean Intellectual Property Office, the entire disclosure of which is hereby incorporated by reference.

BACKGROUND OF THE INVENTION

1. Field of the Invention

The present invention relates to an image forming device, such as a laser printer or a photocopier, heating a fixing unit by alternating current (AC) power. More particularly, the present invention relates to an image fixing control system and method to increase the quality of a fixed image by preventing the occurrence of overshoot or undershoot according to a temperature variation of a heating roller.

2. Description of the Related Art

A heating circuit of a general fixing unit used for laser printers and photocopiers includes a part transferring from a main controller, a control signal for determining whether power is supplied to the fixing unit, a triac for applying alternating current (AC) power to the fixing unit, and a triac driver (for example, a photo coupler) driving a triac.

A conventional fixing circuit for a laser printer performs a simple temperature control by receiving AC power from a power supply and applying the AC power to the fixing circuit. When a main controller detects a temperature of a fixing unit using a temperature sensor and if the main controller determines, according to the detected temperature, that a temperature increase is needed, the main controller applies the AC power to the fixing unit. If the main controller determines, according to the detected temperature, that a temperature decrease is needed, the main controller cuts off the AC power to the fixing unit.

When the AC power is initially applied to the fixing circuit, the main controller quickly heats a heating roller by transmitting a turn-on signal to the fixing unit at a full duty ratio. When the heating roller reaches a predetermined maximum temperature, the main controller decreases a temperature of the heating roller by transmitting a turn-off signal to the fixing unit.

According to a conventional fixing unit control system, since a temperature of a heating roller varies very quickly when the heating roller is initially heated, a function of fixing an image on a print medium is degraded. Accordingly, there is a need for an improved system for and method for efficiently controlling image fixing.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide an image fixing control system and method to vary a duty of power through a phase control using a temperature variation slope of a heating roller.

According to an aspect of exemplary embodiments of the present invention, there is provided an image fixing control system comprising a power supply; a power switching unit; a heating roller; a temperature detector for detecting a temperature of the heating roller; and a controller for detecting a temperature variation slope of the heating roller using the temperature detected by the temperature detector and controlling an on/off switching operation of the power switching unit according to the detected temperature variation slope.

According to another aspect of exemplary embodiments of the present invention, there is provided an image fixing control method used in an image fixing control system comprising a power supply, a power switching unit, and a heating roller, in which a temperature of the heating roller is detected; and a temperature variation slope of the heating roller is detected using the detected temperature and controlling an on and off switching operation of the power switching unit according to the detected temperature variation slope.

BRIEF DESCRIPTION OF THE DRAWINGS

The above and other objects, features and advantages of certain exemplary embodiments of the present invention will be more apparent from the following description taken in conjunction with the accompanying drawings, in which.

Throughout the drawings, the same drawing reference numerals will be understood to refer to the same elements, features and structures

DETAILED DESCRIPTION OF EXEMPLARY EMBODIMENTS

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
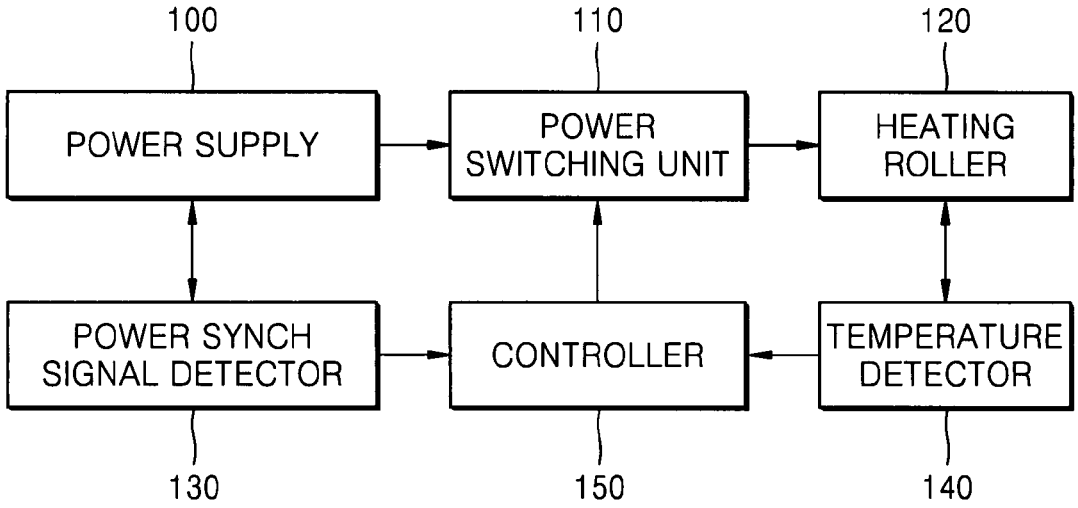
FIG. 1 is a block diagram of an image fixing control system according to an exemplary embodiment of the present invention.

FIG. 1 is a block diagram of an image fixing control system according to an exemplary embodiment of the present invention. Referring to FIG. 1, the system includes a power supply 100, a power switching unit 110, a heating roller 120, a power synch signal detector 130, a temperature detector 140, and a controller 150.

The power supply 100 outputs AC power for heating the heating roller 120 to the power switching unit 110.

The power switching unit 110 performs an on/off switching operation according to a control signal of the controller 150 when the AC power supplied by the power supply 100 is applied to the heating roller 120. To perform the on/off switching operation, the power switching unit 110 may include a photo coupler or a triac.

The heating roller 120 is heated by the AC power supplied by the power supply 100. The heating roller 120 is placed to face a pressure roller (not shown). When a print medium to which an image is being transferred passes through the heating roller 120 and the pressure roller, the image is fixed onto the print medium.

The power synch signal detector 130 detects a power synch signal synchronized with zero crossing times of the AC power supplied by the power supply 100 and outputs a detection result to the controller 150.

Figure 2:
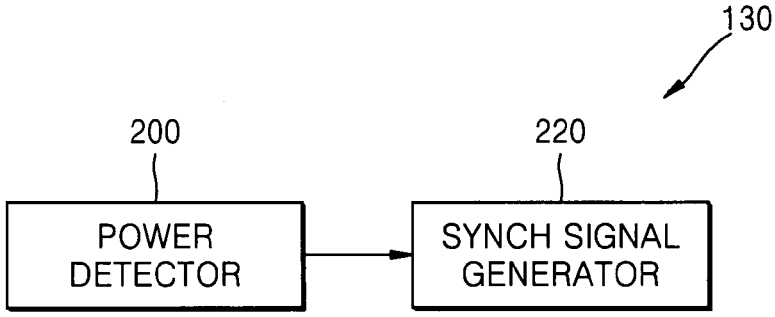
FIG. 2 is a block diagram of a power synch signal detector illustrated in FIG. 1, according to an exemplary embodiment of the present invention.

FIG. 2 is a block diagram of the power synch signal detector 130 illustrated in FIG. 1, according to an exemplary embodiment of the present invention. The power synch signal detector 130 includes a power detector 200 and a synch signal generator 220.

The power detector 200 detects the magnitude and phase of the AC power supplied by the power supply 100 and outputs a detection result to the synch signal generator 220. To detect the magnitude and phase of the AC power, the power detector 200 may include a photo coupler.

The synch signal generator 220 generates a power synch signal synchronized with zero crossing times of the AC power in response to the detection result of the power detector 200.

Figure 3:
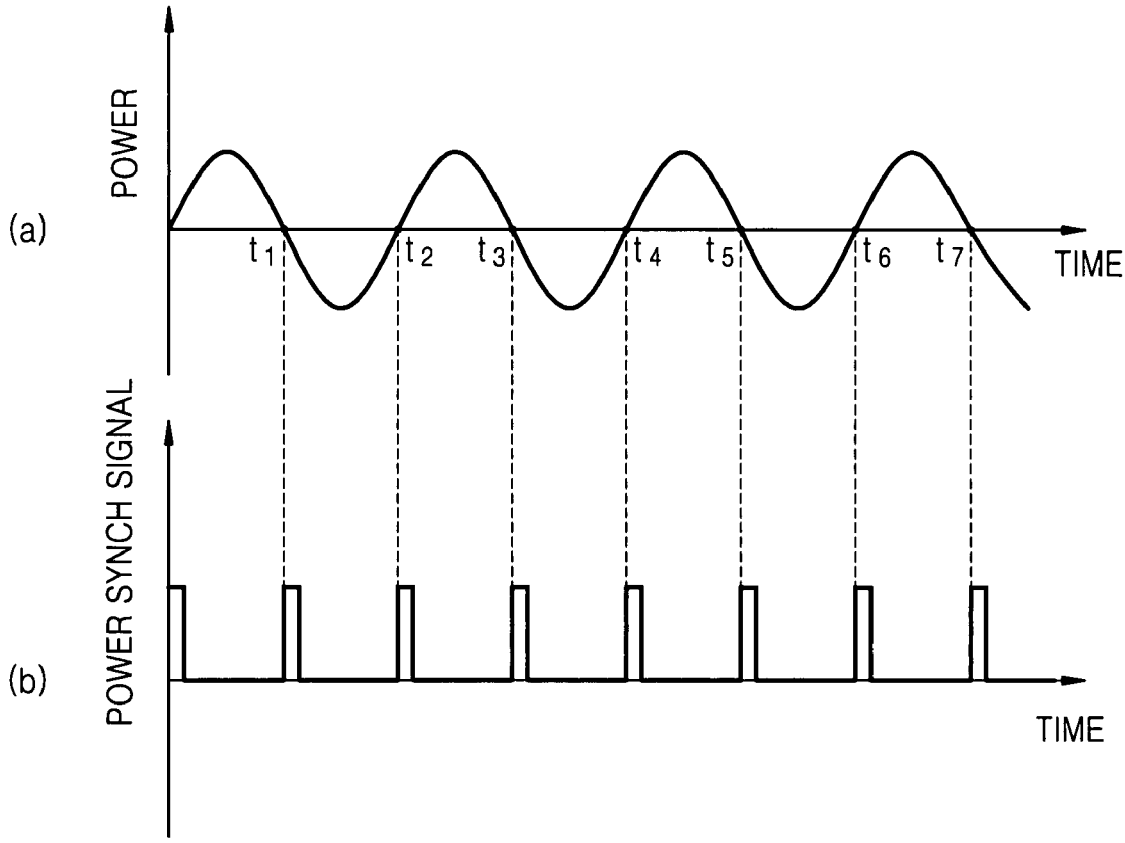
FIGS. 3A and 3B are timing diagrams illustrating a power synch signal with respect to AC power, according to an exemplary embodiment of the present invention.

FIGS. 3A and 3B are timing diagrams illustrating a power synch signal with respect to AC power according to an exemplary embodiment of the present invention.

In FIG. 3A, times t1 to t7 indicate zero crossing times of the AC power.

FIG. 3B illustrates a pulse waveform of the power synch signal synchronized with the zero crossing times of the AC power of FIG. 3A. As illustrated in FIG. 3B, the synch signal generator 220 outputs a pulse at every zero crossing time of the AC power. A pulse waveform formed like this is the power synch signal.

The temperature detector 140 detects a temperature of the heating roller 120 and outputs a detection result to the controller 150. The temperature detector 140 may include a thermistor to detect the temperature of the heating roller 120.

The controller 150 detects a temperature variation slope of the heating roller 120 using the temperature detected by the temperature detector 140 and outputs a control signal, for controlling an on or off operation of the power switching unit 110, to the power switching unit 110 according to the detected temperature variation slope.

The controller 150 receives the temperature detected by the temperature detector 140 and detects the temperature variation slope of the heating roller 120 using a temporal temperature variation rate.

The controller 150 detects a duty ratio of the AC power, which corresponds to the detected temperature variation slope. Duty ratios of the AC power, which correspond to temperature variation slopes, are pre-defined.

The controller 150 controls the on/off switching operation of the power switching unit 110 according to the detected duty ratio based on the power synch signal input from the power synch signal detector 130.

Figure 4:
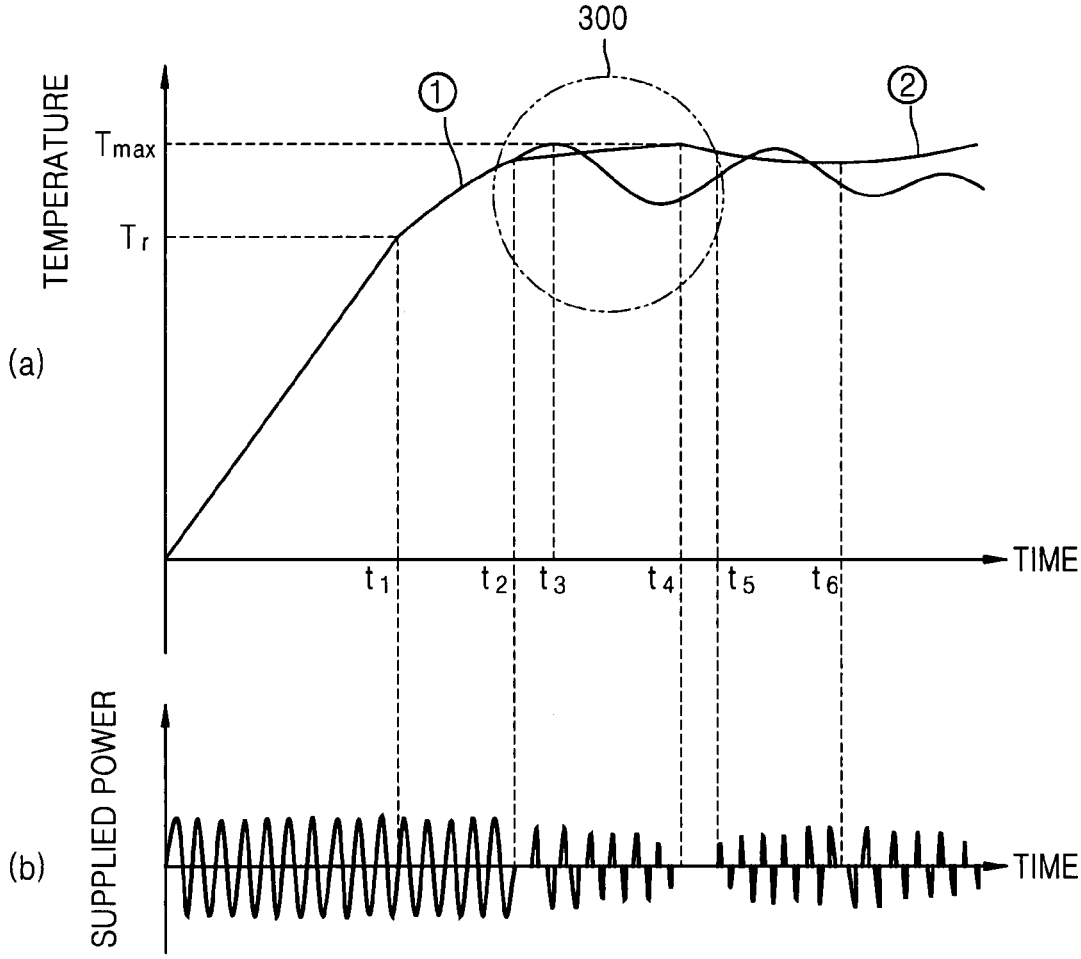
FIGS. 4A and 4B are graphs illustrating a temperature variation trend of a heating roller controlled by the image fixing control system of FIG. 1 and power supplied to the heating roller, according to an exemplary embodiment of the present invention.

FIGS. 4A and 4B are graphs illustrating a temperature variation trend of the heating roller 120 controlled by the image fixing control system of FIG. 1 and power supplied to the heating roller 120, according to an exemplary embodiment of the present invention. Reference numeral ① in FIG. 4A indicates a temperature variation trend of a heating roller controlled by a conventional image fixing control system. In this case, power is supplied to the heating roller at a full duty ratio until a temperature of the heating roller reaches the maximum temperature $T_{max}$. Herein, the temperature of the heating roller linearly increases until it reaches a temperature $T_r$. A slope of the temperature increase becomes relatively gentle from a time t1 to a time t3 corresponding to the maximum temperature $T_{max}$. This is because a pressure roller facing the heating roller absorbs heat of the heating roller while rolling together even though the power is continuously supplied to the heating roller.

If the temperature of the heating roller reaches the maximum temperature $T_{max}$, the power is not supplied to the heating roller, and if the temperature of the heating roller becomes lower than a predetermined temperature, the power is supplied to the heating roller again, thereby heating the heating roller. Thus, as shown from reference numeral ① in FIG. 4A, overshoot and undershoot are repeated until a significant time elapses.

Reference numeral ② in FIG. 4A indicates a temperature variation trend of the heating roller 120 controlled by the image fixing control system according to an exemplary embodiment of the present invention.

Figure 5:
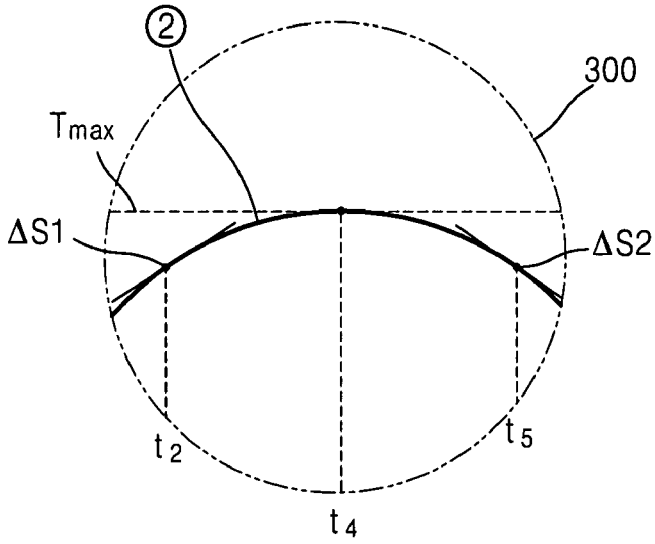
FIG. 5 is a detailed diagram obtained by magnifying a portion of the temperature variation graph illustrated in FIG. 4A.

FIG. 5 is a detailed diagram obtained by magnifying a portion 300 of the temperature variation graph illustrated in FIG. 4A. At a time t2 corresponding to the time when a temperature increase slope is below a predetermined slope ΔS1, the heating roller 120 is heated until a time t4 while gradually decreasing the duty ratio of the AC power, unlike the conventional image fixing control system supplying the power at a full duty ratio. Thus, the overshoot occurring in a process of increasing the temperature of the heating roller 120 to the maximum temperature $T_{max}$ can be minimized.

At a time t5 corresponding to the time when a temperature decrease slope is below a predetermined slope ΔS2, the heating roller 120 is heated while gradually increasing the duty ratio of the AC power, unlike the conventional image fixing control system cutting off the power. Thus, by continuously supplying proper AC power to the heating roller 120 even during a decrease of the temperature of the heating roller 120, the undershoot occurring in a process of decreasing the temperature of the heating roller 120 can be minimized.

FIG. 4B is a graph showing the supplied power. From time t2 to time t4, the controller 150 controls the on and off switching operation of the power switching unit 110 so that the duty ratio of the AC power supplied to the heating roller 120 is gradually decreased, and from time t4 to time t6, the controller 150 controls the on/off switching operation of the power switching unit 110 so that the duty ratio of the AC power supplied to the heating roller 120 is gradually increased. In addition, since the temperature of the heating roller 120 increases again after time t6, the controller 150 controls the on and off switching operation of the power switching unit 110 after time t6 so that the duty ratio of the AC power supplied to the heating roller 120 is gradually decreased again.

Figure 6:
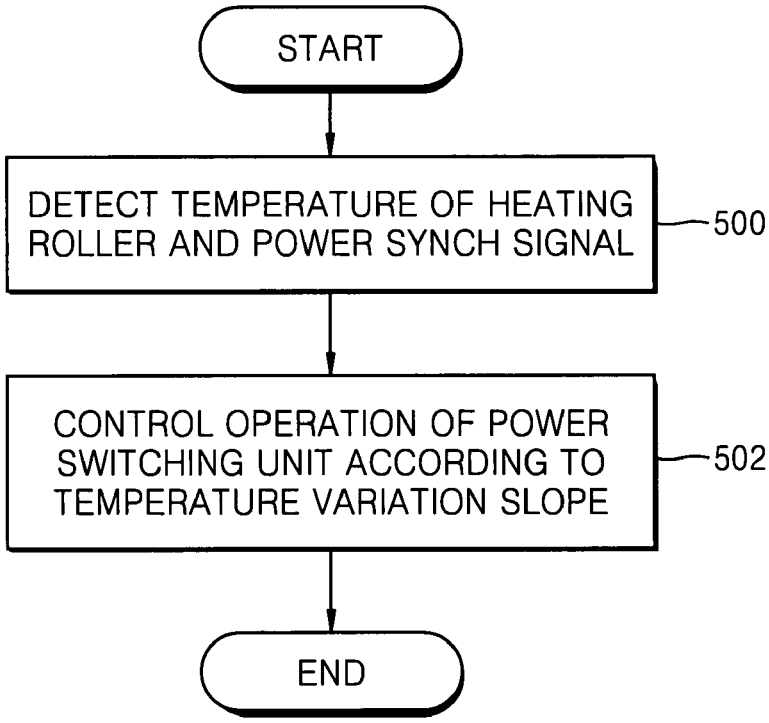
FIG. 6 is a flowchart illustrating an image fixing control method according to an exemplary embodiment of the present invention.

FIG. 6 is a flowchart illustrating an image fixing control method according to an exemplary embodiment of the present invention.

Referring to FIG. 6, a temperature of the heating roller 120 and a power synch signal are detected in step 500.

The power synch signal is a signal synchronized with zero crossing times of AC power supplied by the power supply 100.

Figure 7:
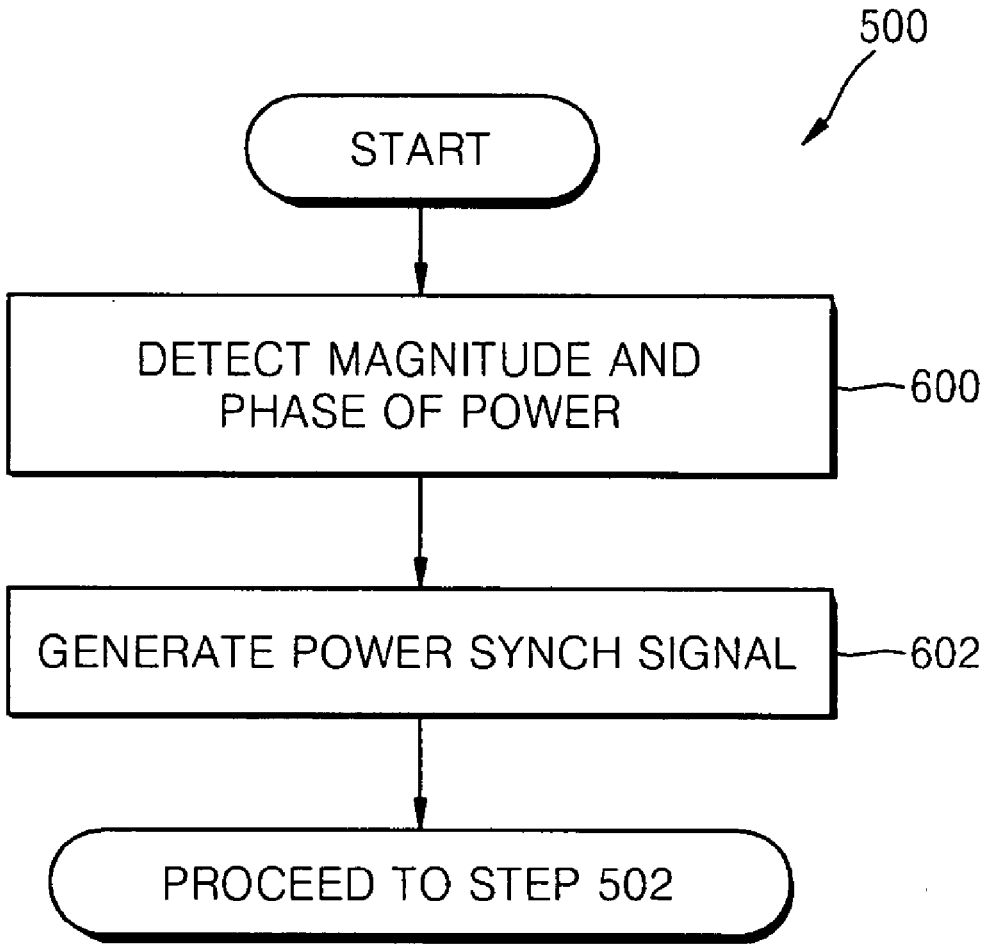
FIG. 7 is a flowchart illustrating a process of detecting a power synch signal as illustrated in FIG. 6, according to an exemplary embodiment of the present invention.

FIG. 7 is a flowchart illustrating step 500 of FIG. 6, that is, a process of detecting the power synch signal, according to an exemplary embodiment of the present invention.

Referring to FIG. 7, the magnitude and phase of the AC power are detected in step 600.

In step 602, a power synch signal is generated in response to the detected magnitude and phase of the AC power. As illustrated in FIG. 3B, a pulse waveform corresponding to the power synch signal is output at every zero crossing time of the AC power.

Referring back to FIG. 6, in step 502, a temperature variation slope of the heating roller 120 is detected using the detected power synch signal and temperature, and an on/off switching operation of the power switching unit 110 is controlled according to the detected temperature variation slope. In particular, the on/off switching operation of the power switching unit 110 is controlled according to a duty ratio of the AC power corresponding to the temperature variation slope. Herein, the duty ratio of the AC power corresponding to the temperature variation slope is pre-defined.

As illustrated in FIG. 5, at time t2 corresponding to the time when a temperature increase slope is below the predetermined slope ΔS1, the heating roller 120 is heated until time t4 while gradually decreasing the duty ratio of the AC power. Thus, the overshoot occurring in a process of increasing the temperature of the heating roller 120 to the maximum temperature $T_{max}$ can be minimized.

At time t5 corresponding to the time when a temperature decrease slope is below the predetermined slope ΔS2, the heating roller 120 is heated while gradually increasing the duty ratio of the AC power. Thus, by continuously supplying proper AC power to the heating roller 120 even during a decrease of the temperature of the heating roller 120, unlike in the conventional image fixing control method, the undershoot occurring in a process of decreasing the temperature of the heating roller 120 can be minimized.

The image fixing control method described above is performed when the heating roller 120 is initially heated since a probability of occurrence of the overshoot or undershoot according to a temperature variation is relatively low in a state where the heating roller 120 operates normally after being heated, as compared to a state where the heating roller 120 is initially heated in which the probability of occurrence of the overshoot or undershoot according to a temperature variation is relatively high.

The exemplary embodiments of the present invention can be written as codes/instructions/programs and can be implemented in general-use digital computers that execute the codes/instructions/programs using a computer readable recording medium. Examples of the computer readable recording medium include magnetic storage media (for example, ROM, floppy disks, hard disks, and the like), and optical recording media (for example, CD-ROMs, or DVDs), and other storage media. Also, functional programs, codes, and code segments for accomplishing the present invention can be easily construed by programmers skilled in the art to which the present invention pertains.

As described above, according to the exemplary embodiments of the present invention, by varying a duty ratio of power through a phase control using a temperature variation slope of a heating roller, a fine control of a fixing system can be performed.

In addition, since a temperature variation, that is, overshoot or undershoot, of the heating roller is reduced, a fixing efficiency of an image can be increased.

While the present invention has been particularly shown and described with reference to certain exemplary embodiments thereof, it will be understood by those skilled in the art that various changes in form and details may be made therein without departing from the spirit and scope of the present invention as defined by the following claims.

What is claimed is:

1. An image fixing control system comprising:

a power switching unit connected to a power supply;

a heating roller;

a temperature detector for detecting a temperature of the heating roller; and a controller for detecting a temperature variation slope of the heating roller using the temperature detected by the temperature detector and controlling an on and off switching operation of the power switching unit according to the detected temperature variation slope, wherein the controller causes varying a duty ratio of power to be supplied to the heating roller according to the detected temperature variation slope, when power is supplied to the heating roller;

wherein the controller controls the on and off switching operation of the power switching unit according to the duty ratio of power to be supplied to the heating roller; and wherein the duty ratio of power is gradually increased when a temperature decrease slope based on the detected temperature variation slope is below a second predetermined slope, and the duty ratio of power is gradually decreased when a temperature increase slope based on the detected temperature variation slope is below a first predetermined slope.

2. The image fixing control system of claim 1, wherein the power switching unit comprises at least one of a photo coupler or triac.

3. The image fixing control system of claim 1, wherein the temperature detector comprises a thermistor.

4. The image fixing control system of claim 1, wherein the duty ratio of power corresponding to the temperature variation slope is pre-defined.

5. The image fixing control system of claim 1, further comprising a power synch signal detector for detecting a power synch signal synchronized with zero crossing times of power supplied by the power supply.

6. The image fixing control system of claim 5, wherein the power synch signal detector comprises:

a power detector for detecting a magnitude and a phase of the power; and a synch signal generator for generating the power synch signal in response to a detection result of the power detector.

7. The image fixing control system of claim 6, wherein the power detector comprises a photo coupler.

8. An image fixing control method used in an image fixing control system comprising a power supply, a power switching unit, and a heating roller, the method comprising:

detecting a temperature of the heating roller;

detecting a temperature variation slope of the heating roller using the detected temperature;

controlling an on and off switching operation of the power switching unit according to the detected temperature variation slope; and causing varying a duty ratio of power to be supplied to the heating roller according to the detected temperature variation slope, when power is supplied to the heating roller;

wherein the controlling of the on and off switching operation is performed according to the duty ratio of power to be supplied to the heating roller; and wherein the duty ratio of power is gradually increased when a temperature decrease slope based on the detected temperature variation slope is below a second predetermined slope, and the duty ratio of power is gradually decreased when a temperature increase slope based on the detected temperature variation slope is below a first predetermined slope.

9. The method of claim 8, wherein the duty ratio of power corresponding to the temperature variation slope is pre-defined.

10. The method of claim 8, further comprising detecting a power synch signal synchronized with zero crossing times of a power supplied by the power supply.

11. The method of claim 10, wherein the detecting of the power synch signal comprises:

detecting a magnitude and phase of the power;

generating the power synch signal in response to the detected magnitude and phase of the power.

12. The method of claim 8, wherein the method is performed when the heating roller is initially heated.

13. A non-transitory computer readable recording medium storing a computer readable program for executing an image fixing control method used in an image fixing control system comprising a power supply, a power switching unit, and a heating roller, the method comprising:

detecting a temperature of the heating roller;

detecting a temperature variation slope of the heating roller using the detected temperature;

controlling an on and off switching operation of the power switching unit according to the detected temperature variation slope; and causing varying a duty ratio of the power to be supplied to the heating roller according to the detected temperature variation slope, when power is supplied to the heating roller;

wherein the controlling of the on and off switching operation is performed according to the duty ratio of power to be supplied to the heating roller; and wherein the duty ratio of power is gradually increased when a temperature decrease slope based on the detected temperature variation slope is below a second predetermined slope, and the duty ratio of power is gradually decreased when a temperature increase slope based on the detected temperature variation slope is below a first predetermined slope.

14. The method of claim 13, wherein the duty ratio of power corresponding to the temperature variation slope is pre-defined.

15. The method of claim 13, further comprising detecting a power synch signal synchronized with zero crossing times of power supplied by the power supply.

16. The method of claim 15, wherein the detecting of the power synch signal comprises:

detecting a magnitude and phase of the power;

generating the power synch signal in response to the detected magnitude and phase of the power.

17. The method of claim 13, wherein the method is performed when the heating roller is initially heated.

18. An image fixing control system comprising:

a power switching unit;

a power supply;

a controller for detecting a temperature variation slope of a heating roller using the temperature detected by a temperature detector and controlling an on and off switching operation of the power switching unit according to the detected temperature variation slope; and a power synch signal detector for detecting a power synch signal synchronized with zero crossing times of power supplied by the power supply;

a power switching unit connected to a power supply;

wherein the controller causes varying a duty ratio of power to be supplied to the heating roller according to the detected temperature variation slope, when power is supplied to the heating roller;

wherein the controller controls the on and off switching operation of the power switching unit according to the duty ratio of power corresponding to the temperature variation slope; and wherein the duty ratio of power is gradually increased when a temperature decrease slope based on the detected temperature variation slope is below a second predetermined slope, and the duty ratio of power is gradually decreased when a temperature increase slope based on the detected temperature variation slope is below a first predetermined slope.

19. The image fixing control system of claim, wherein the power switching unit comprises at least one of a photo coupler and triac.

20. The image fixing control system of claim 18, wherein the power synch signal detector comprises:

a power detector for detecting a magnitude and a phase of the power; and a synch signal generator for generating the power synch signal in response to a detection result of the power detector.

21. The image fixing control system of claim 20, wherein the power detector comprises a photo coupler.

22. An image fixing control system comprising:

a power switching unit connected to a power supply;

a heating roller;

a temperature detector comprising a thermistor for detecting a temperature of the heating roller; and a controller for controlling switching operation of the power switching unit in accordance with the temperature detector and for detecting a temperature variation slope of the heating roller using the temperature detected by the temperature detector;

wherein the controller causes varying a duty ratio of power to be supplied to the heating roller in accordance with the temperature detector, when power is supplied to the heating roller;

wherein the controller controls an on and off switching operation of the power switching unit according to the duty ratio of power corresponding to the detected temperature variation slope; and wherein the duty ratio of power is gradually increased when a temperature decrease slope based on the detected temperature variation slope is below a second predetermined slope, and the duty ratio of power is gradually decreased when a temperature increase slope based on the detected temperature variation slope is below a first predetermined slope.

23. The image fixing control system of 22, wherein the power switching unit comprises at least one of a photo coupler and triac.

24. The image fixing control system of claim 22, further comprising a power synch signal detector for detecting a power synch signal synchronized with zero crossing times of power supplied by the power supply.

25. The image fixing control system of claim 24, wherein the power synch signal detector comprises:

a power detector for detecting a magnitude and a phase of the power; and a synch signal generator for generating the power synch signal in response to a detection result of the power detector.

26. The image fixing control system of claim 25, wherein the power detector comprises a photo coupler.

* * * * *